United States Patent [19]

Daughton et al.

[11] Patent Number: 4,475,806

[45] Date of Patent: Oct. 9, 1984

[54] COPIER DISPLAY PANEL

[75] Inventors: John W. Daughton, Webster; Andras I. Lakatos, Penfield; Terence W. Brady, Webster; James R. Bryce, Fairport; Eugene S. Evanitsky, Pittsford; George E. Baker, Rochester, all of N.Y.

[73] Assignee: Xerox Corporation, Stamford, Conn.

[21] Appl. No.: 420,963

[22] Filed: Sep. 21, 1982

[51] Int. Cl.[3] ..... G03G 15/00

[52] U.S. Cl. ..... 355/14 R; 355/14 C; 340/715; 340/716; 340/758; 340/784

[58] Field of Search ..... 355/14 R, 14 C, 3 R, 355/77; 340/691, 715, 716, 758, 784, 815.21

[56] References Cited

U.S. PATENT DOCUMENTS

| | | | |
|---|---|---|---|
| 3,958,239 | 5/1976 | Green | 340/365 |
| 3,971,013 | 7/1976 | Challoner et al. | 340/337 |
| 4,035,072 | 7/1977 | Dietz et al. | 355/14 |
| 4,103,331 | 7/1978 | Thacker | 364/200 |
| 4,158,886 | 6/1979 | Gray, Jr. et al. | 364/518 |
| 4,176,941 | 12/1979 | Breitenkam | 355/14 R |
| 4,211,473 | 7/1980 | Shanks | 350/337 |
| 4,260,241 | 4/1981 | Honma et al. | 355/14 R |
| 4,300,829 | 11/1981 | Braswell et al. | 355/14 R |
| 4,327,994 | 5/1982 | Barley et al. | 355/14 R |
| 4,332,464 | 6/1982 | Bartulis et al. | 355/14 C |
| 4,350,439 | 9/1982 | Tanioka et al. | 355/14 R |
| 4,390,872 | 6/1983 | Murakami et al. | 340/784 X |
| 4,394,087 | 7/1983 | Irie et al. | 355/14 R |
| 4,398,819 | 8/1983 | Schron | 355/14 CU |
| 4,408,869 | 10/1983 | Tomosada et al. | 355/14 C |
| 4,412,735 | 11/1983 | Tsukata et al. | 355/14 R |

FOREIGN PATENT DOCUMENTS

| | | | |
|---|---|---|---|
| 3043081 | 5/1981 | Fed. Rep. of Germany | 355/14 C |
| 7411641 | 11/1974 | Netherlands . | |
| 2041572 | 9/1980 | United Kingdom | 355/14 C |

OTHER PUBLICATIONS

*Research Disclosure,* No. 126, pp. 41–42, Oct. 1974, "Assistance Code Display".

IBM Technical Disclosure Bulletin, vol. 18, No. 10, Mar./1976; by M. J. Miller; "Program Control of Job Control Information Entry for Copier".

*Primary Examiner*—R. L. Moses

[57] ABSTRACT

A display for use in conjunction with a copier. The disclosed display comprises two microprocessors for controllably displaying information on a display panel of a xerographic copier. A first microprocessor is primarily responsible for energizing alphanumeric elements to either send messages to the copier user or to prompt the user to interact with the copier. A second display is a liquid crystal display wherein selectively energizable liquid crystal elements corresponding to copier components can be rendered visible under the control of the second microprocessor. An overlay pattern can be placed above the liquid crystal display to present to the user in outline form the copier architecture with which he is interacting. This overlay can be changed as the copier configuration is changed. The electronics for controlling the display of alphanumeric allows the utilization of different fonts and/or different languages. This flexibility allows the copier to prompt, and/or display information regarding copier status in various languages without a redesign of the display unit.

8 Claims, 20 Drawing Figures

COPIER DISPLAY PANEL

BACKGROUND OF THE INVENTION

1. Field of the Invention

The present invention relates to a xerographic copier and more specifically to a display panel which communicates to a copier user the status of the copier as well as prompting the user to interact with the copier.

2. Prior Art

As the art of xerographic copying has matured, the design of xerographic marking engines used in practicing xerography has also matured. Xerographic copiers are now capable of automatically making two-sided copies from two-sided originals and stacking a desired number of stapled copy sets in an output tray. Different copying options are available on the same basic xerographic marking engine so that while one copier may have a recirculating document handler for automatically moving original documents past a copier platen, another may only have a platen and platen cover requiring the user to individually insert and copy each original. The availability of different options allows the user to satisfy his copying needs with the most efficient expenditure of money.

Certain convenience features are available which make it easier for the user to interact with the copier. Automatic billing equipment, for example, automatically informs the user of what client the particular job being run on the copier is performed for and also how many copies that particular job entails. Other convenience features added to the xerographic copier allow the user to more efficiently and intelligently interact with the copier. Human Factors Engineering has made it easier for an uninitiated operator to learn how the copier operates and how to diagnose and correct faults when they occur in the copier operation. This training and/or copier diagnostics naturally becomes more complex as the copier sophistication increases. In addition, if the operator has familiarity with one type of copier and encounters a differently configured copier, he may be predisposed to a diagnostic procedure unsuited for the new machine.

Alphanumeric displays have been used to both prompt and alert the user of copier status and faults. Statements such as "Standby," "Please Wait," "Ready," "Insert Documents," and "Select Number of Copies," have been used to alert the user to the status and operation of the copier. Similar display units have generated alphanumeric error codes which refer the user to a flip chart giving instructions on how to correct various problems and/or faults encountered during copier operation.

Although not commercially exploited to the extent of alphanumeric displays, graphic displays have been suggested as ways to further educate the copier user regarding the status of the copier. These graphic displays or icons graphically illustrate a copier configuration and can involve the use of selectively energizable elements to cue the user as to what portion of the copier needs attention and/or maintenance. Thus, in a copier incorporating a recirculating document handler, a flashing icon of such a document handler positioned in relation to the rest of the copier may indicate to the user a jam in the paper circulating in the document handler. This type of cueing can be particularly effective when coupled with an alphanumeric message re-enforcing the user's perception that he has been educated as to the source of his problem.

As alluded to above, a user can require a copier to be configured depending upon his needs without changing the basic makeup of the xerographic marking engine. The Human Factors Engineer is accordingly faced with a problem of displaying status and/or fault information regarding a copier which may be configured in a number of different ways. This problem of copier interfacing is made more difficult if the copier is to be used in areas where different languages are spoken. Thus, the alphanumeric display suitable for an English language speaking country would be unsuitable in a land where only Spanish was spoken. Some locals (Quebec for example) require a copier which communicates in two languages since significant percentages of the people speak different languages. The engineer is then faced with the problem of either designing a separate display for each copier configuration and geographic location or trying to design a system generic enough to suit all possible copier configurations and languages.

SUMMARY OF THE INVENTION

The present invention relates to method and apparatus for presenting copier status information to a user. The present display functions with a variety of xerographic copier configurations and can be easily modified to represent alphanumeric information in a variety of languages. The display has its own programmable controller which interacts with other electronics inside the copier to monitor the status of the copier and update the user as to the status of the copier during operation.

The display panel includes a message generation panel having a number of individually addressable character generators which can be activated and rendered visible. The panel further includes a liquid crystal display having a pattern of energizable elements which correspond to various copier components. Circuitry is coupled to both the display and the message generator panel to coordinate the visible message presented by the message generation panel with the energization of the liquid crystal elements to inform the user viewing the panel of the status of the copier. An overlay is provided which displays the particular copier configuration. This overlay can be changed for different copier options.

The use of overlays representing a particular copier configuration allows a single liquid crystal display to be used for each of a multiple number of copier configurations. This liquid crystal display shows the outline of various copier components such as a platen, paper tray, output tray, or finishing station. In a preferred embodiment of the present invention, the liquid crystal display includes over thirty actuatable elements (a larger number is possible) which can be turned on in either a flashing or continuous manner.

Working in conjunction with the liquid crystal display is the message generation panel which, in a preferred embodiment of the invention, comprises a vacuum flourescent display having the capability of displaying forty alphanumeric characters. Each alphanumeric character comprises a $5\times7$ dot matrix display which, when activated by the controller coupled to the display, portrays a particular character. The particular font for the display is stored in controller memory and in accordance with the preferred embodiment is stored in a non-volatile ROM memory chip. By substituting a different memory, a different font or language can be readily displayed on the character generation display.

The character display and liquid crystal display work in conjunction to update the user regarding the status of copier. The programmable unit responsible for display operation is continually updated regarding copier status by a separate programmable unit. This other programmable unit interfaces with a plurality of sensors or transducers located throughout the copier. By way of example, a sensor located in the main paper tray senses the lack of paper in that tray and transmits a signal to the main processor when the paper tray is empty. The main processor then instructs the processor responsible for energizing the display panel that the paper tray is empty. The second programmable unit then causes a message to appear on the character message generation means indicting paper should be added to the paper tray. At the same time, the second controller also actuates the display to cause a liquid crystal element to energize indicating to the user that the paper tray needs attention. This liquid crystal element is configured to graphically represent the paper tray and is located in relation to the overlay or outline of the copier configuration to more readily inform the user where the paper tray is located.

It should be appreciated from the above one object and advantage of the present invention is the coordination of an alphanumeric and graphic copier status update to the user. Other objects, advantages and features of the present invention will become better understood when a detailed description of a preferred embodiment of the invention is discussed in conjunction with the accompanying drawings.

DETAILED DESCRIPTION OF A PREFERRED EMBODIMENT

Figure 1:
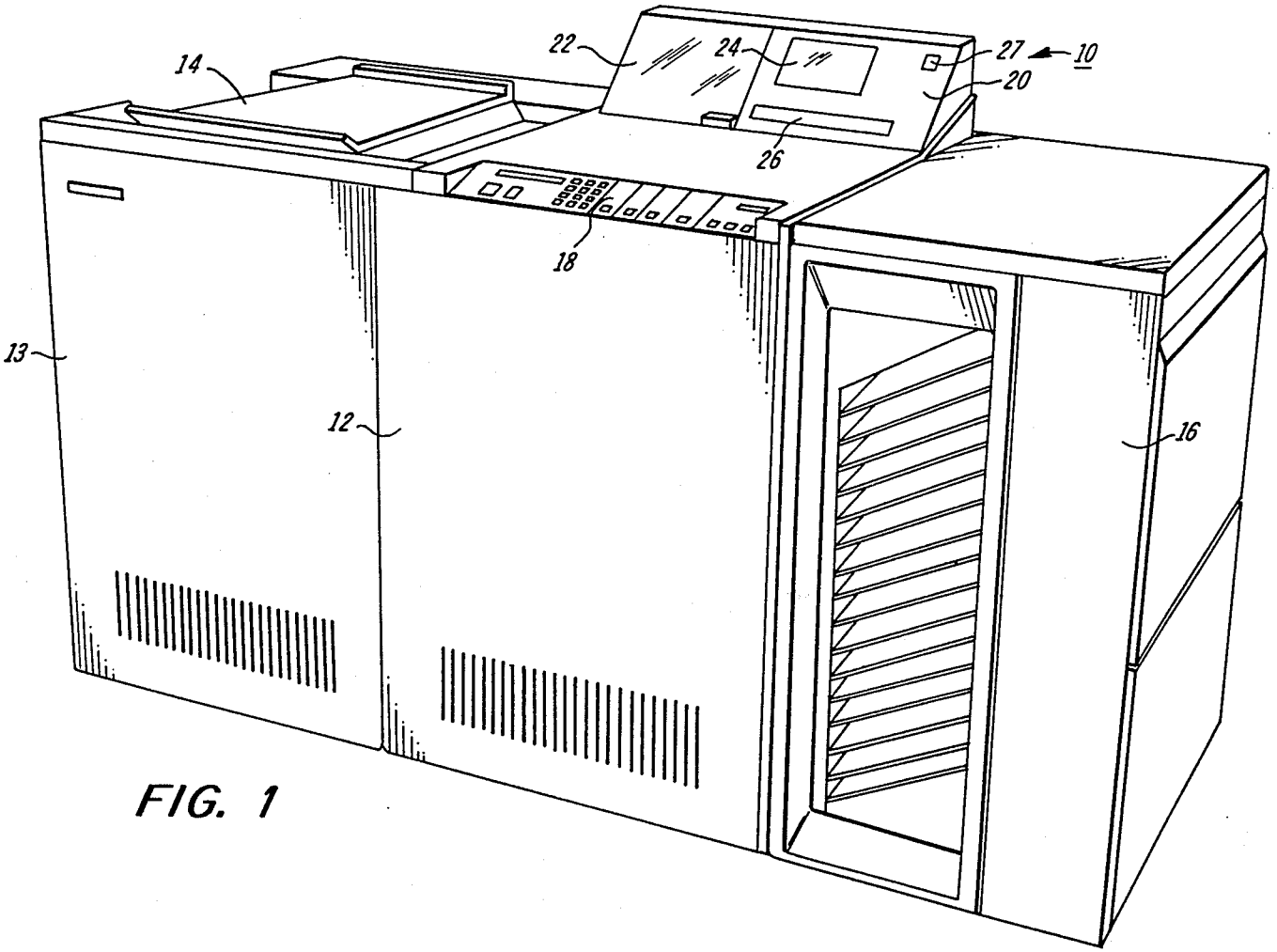
FIG. 1 is a schematic of one xerographic copier configuration with which the present invention has utility.

Turning now to the drawings, and in particular to FIG. 1, there is shown a copier 10 suitable for making xerographic copies from document originals. The copier 10 includes a housing 12 which provides an attractive appearance and covers copier components to be described in relation to the other figures. The particular copier 10 illustrated includes a platen and platen cover 14 but no automatic document handler. The platen cover 14 is hinged to allow the user to raise and lower the cover 14 and insert document originals onto the platen for copying. The copier 10 also includes a sorter 16 which provides collated copy sets of multiple document orignals. A control panel 18 allows a user to select copy size, copy contrast, number of copies to be made, and the manner (duplex, for example) in which the copies are to be made. Also included on the panel 18 is a button for initiating the copying function.

A display panel 20 informs the user of the status of the copier 10 and can be used to prompt the user to take corrective action in the event of a fault in copier operation. The display panel 20 includes a flip chart 22, an LCD display 24, an alphanumeric display 26 and a "Power On" button 27. The present invention relates to the particulars of the cooperation of the LCD display 24 with the alphanumeric display 26 to efficiently prompt the user regarding copier status, inform him of certain faults as they occur, and refer the user to the flip chart 22 in the event the instructions to be given are more complex than can be conveniently displayed on the LCD and alphanumeric displays 24,26.

As the user approaches the copier 10, both the LCD display and alphanumeric display 24,26 are blank and can display nothing until the user activates the "Power On" switch 27 to energize the power supply inside the copier 10. Once the power has been turned on, a "Standby" message will appear on the alphanumeric display 26 indicating the copier is not yet ready for use. Once the copier 10 is ready for making xerographic copies, the alphanumeric display 26 shows a "Ready To Make Copies" message telling the user the copier 10 is ready for operation.

Figure 2:
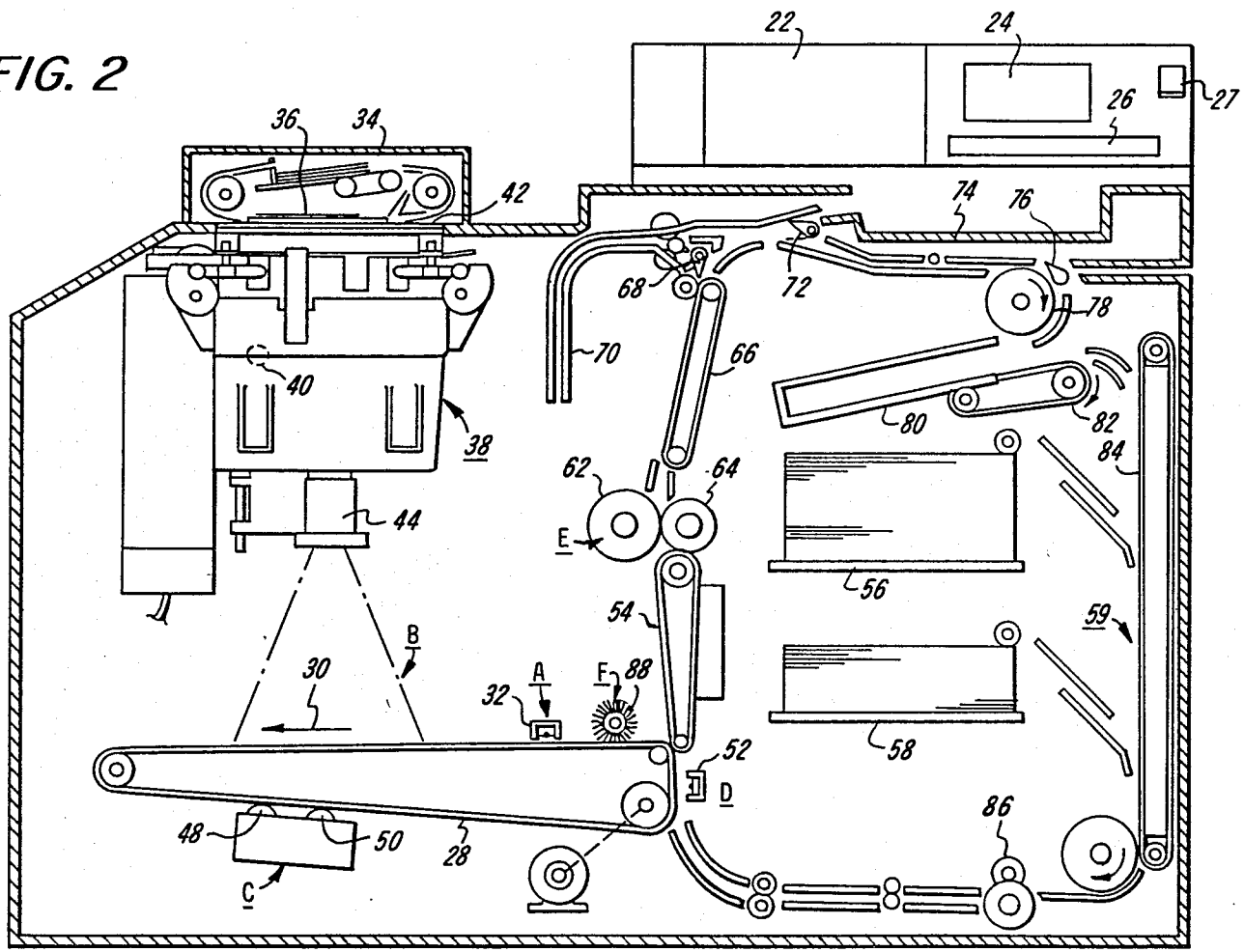
FIG. 2 is a schematic showing certain xerographic copier components in a typical xerographic copier.

Many of the components used in generating xerographic copies are displayed schematically in FIG. 2. As shown in FIG. 2, the illustrative electrophotographic printing machine 10 employs a belt 28 having a photoconductive surface thereon. Belt 28 moves in the direction of arrow 30 to advance successive portions of the photoconductive surface through the various processing stations disposed about the belt.

Initially, a portion of the photoconductive surface passes through charging station A. At charging station A, a corona generating device, indicated generally by the reference numeral 32, charges the photoconductive surface to a relatively high substantially uniform potential.

Next, the charged portion of the photoconductive surface is advanced through imaging station B. At imaging station B, a document handling unit, indicated generally by the reference numeral 34, positions original documents 36 facedown over exposure system 38. In this regard, it should be noted that the FIG. 2 schematic differs from the copier shown in FIG. 1 since that copier has no document handler. As will be seen, however, the display panel 20 functions with either configuration.

The exposure system, indicated generally by reference numeral 38 includes lamp 40 which illuminates the document 36 positioned on transparent platen 42. The light rays reflected from document 36 are transmitted through lens 44. Lens 44 focuses the light image of original document 36 onto the charged portion of the photoconductive surface of belt 28 to selectively dissipate the charge. This records an electrostatic latent image on the photoconductive surface which corresponds to the informational areas contained within the original document. Thereafter, belt 28 advances the electrostatic latent image recorded on the photoconductive surface to development station C. Platen 42 is mounted movably and arranged to move to adjust the magnification of the original document being reproduced. Lens 44 moves in synchronism therewith so as to focus the light image of original document 36 onto the charged portion of the photoconductive surface of belt 28.

Document handling unit 34 sequentially feeds documents from a stack of documents placed by the operator in a normal forward collated order in a document stacking and holding tray. The documents are fed from the holding tray, in seriatim, to platen 42. The document handling unit recirculates documents back to the stack supported on the tray. Preferably, the document handling unit is adapted to serially sequentially feed the documents, which may be of various sizes and weights of paper.

While the document handling unit has been described, one skilled in the art will appreciate that the original document may be manually placed on the platen rather than by the document handling unit. This is required for a printing machine which does not include a document handling unit (See FIG. 1 copier).

With continued reference to FIG. 2, at development station C, a pair of magnetic brush developer rollers, indicated generally by the reference numerals 48 and 50, advance a developer material into contact with the electrostatic latent image. The latent image attracts toner particles from the carrier granules of the developer material to form a toner powder image on the photoconductive surface of belt 28.

After the electrostatic latent image recorded on the photoconductive surface of belt 28 is developed, belt 28 advances the toner powder image to transfer station D. At transfer station D, a copy sheet is moved into transfer relation with the toner powder image. Transfer station D includes a corona generating device 52 which sprays ions onto the backside of the copy sheet. This attracts the toner powder image from the photoconductive surface of belt 28 to the sheet. After transfer, conveyor 54 advances the sheet to fusing station E. The copy sheets are fed from a selected one of trays 56 or 58 into the paper path 59 and to transfer station D.

Fusing station E includes a fuser assembly which permanently affixes the transferred powder image to the copy sheet. Preferably, fuser assembly includes a heated fuser roller 62 and backup roller 64. The sheet passes between fuser roller 62 and backup roller 64 with the powder image contacting fuser roller 62. In this manner, the powder image is permanently affixed to the sheet.

After fusing, conveyor 66 transports the sheets to gate 68 which functions as an inverter selector. Depending upon the position of gate 68, the copy sheets will either be deflected into a sheet inverter 70 or bypass sheet inverter 70 and be fed directly onto a second decision gate 72. Thus, copy sheets which bypass inverter 70 turn a 90° corner in the sheet path before reaching gate 72. At gate 72 the sheets are in a face-up orientation so that the imaged side which has been transferred and fused is faceup. If inverter path 70 is selected, the opposite is true, i.e. the last printed face is facedown. Second decision gate 72 deflects the sheet directly into an output tray 74 or deflects the sheet into a transport path which carries the sheet to a third decision gate 76. Gate 76 either passes the sheets directly on, without inversion, to the copier output or routes the sheets into a duplex inverter roll transport 78. Inverting transport 78 inverts and stacks the sheets to be duplexed in a duplex tray 80 when gate 76 so directs. Duplex tray 80 provides intermediate or buffer storage for those sheets which have been printed on one side and on which an image will be subsequently printed on the side opposed thereto, i.e. the copy sheets being duplexed. Due to the sheet inverting action of rollers 78, the buffer set sheets are stacked in duplex tray 80 facedown in the order in which the sheets have been copied.

In order to complete duplex copying the peviously simplexed sheets in tray 80 are fed seriatim by bottom feeder 82 back to transfer station D for transfer of the toner powder image to the opposed side of the sheet. Conveyors 84 and 86 advance the sheet along a path which produces an inversion thereof. However, inasmuch as the bottommost sheet is fed from duplex tray 80, the proper or clean side of the copy sheet is positioned in contact with belt 28 at transfer station D so that the toner powder image thereon is transferred thereto. The duplex sheets are then fed through the same path as the previously simplexed sheets to be stacked in tray 74 for subsequent removal by the user.

Returning now to the operation of the printing machine, invariably after the copy sheet is separated from the photoconductive surface of belt 10, some residual particles remain adhering to belt 28. These residual particles are removed from the photoconductive surface thereof at cleaning station F. Cleaning station F includes a rotatably mounted brush 88 in contact with the photoconductive surface of belt 28. These particles are cleaned from the photoconductive surface of belt 28 by the rotation of the brush 88 in contact therewith. Subsequent to cleaning, a discharge lamp (not shown) floods the photoconductive surface with light to dissipate any residual electrostatic charge prior to the charging for the next successive imaging cycle.

Figure 3:
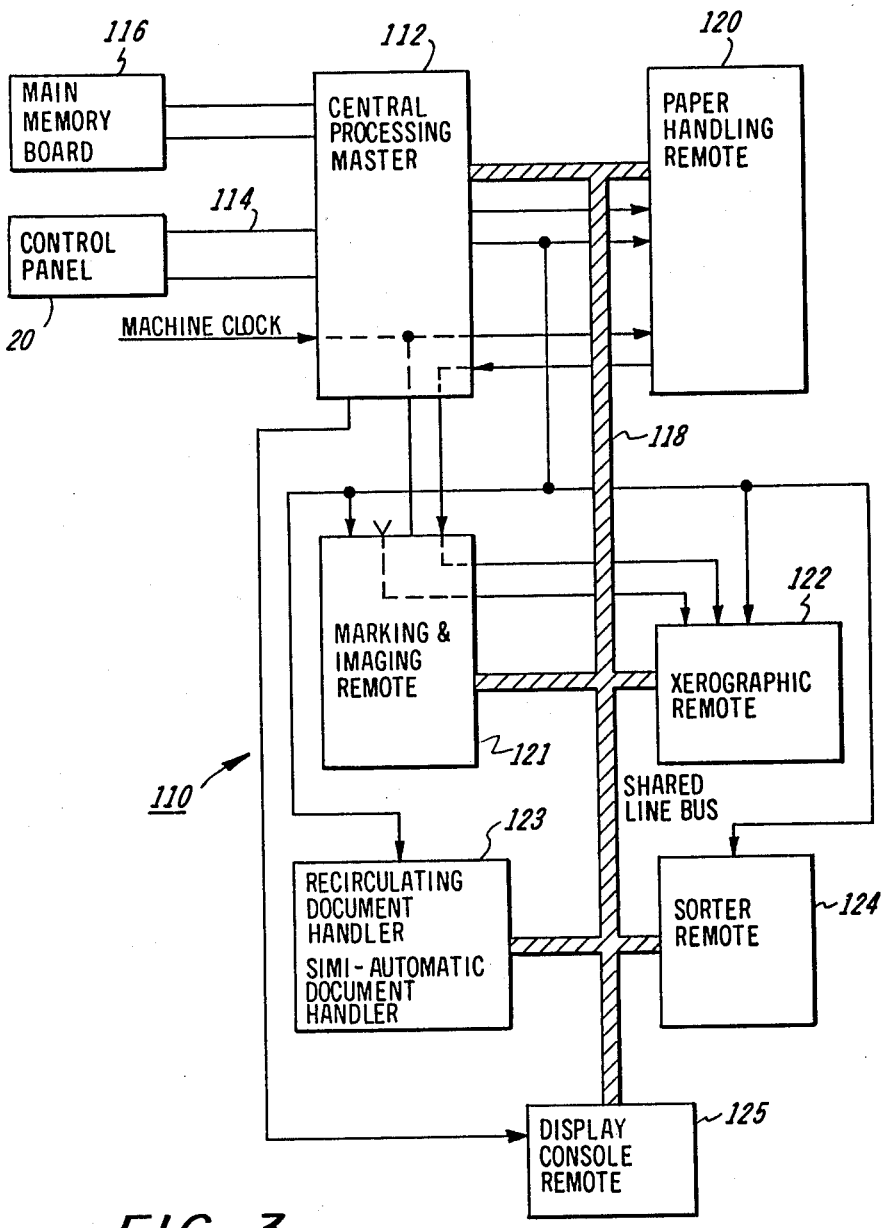
FIG. 3 discloses a schematic of the electronics used to both control and monitor xerographic functions inside a copier.

The functioning of the FIG. 2 components comprising the copier 10 is controlled and monitored by an electronics subsystem 110 (FIG. 3) comprising a number of programmable controllers which communicate with a master central processor 112. An interface 114 between the control panel 20 and main processor 112 apprises the processor 112 of inputs entered by the user regarding number of copies, etc. The main processor 112 responds to user inputs by executing its operating system stored in a main memory unit 116.

The algorithm in main memory 116 causes the master central processor 112 to communicate along a communications bus 118 to a number of remote electronics units 120–125 used to monitor and control the copier. The specific units 120–125 vary with copier architecture so the FIG. 3 schematic is representative of one of many possible electric subsystems schematics. Each unit 120–125 has its own microprocessor with accompanying memory (both RAM and ROM) and support circuitry.

The LCD and alphanumeric displays 24,26 are electrically coupled to a display console remote unit 125. The display console remote unit 125 receives status information, fault information, or program control information from the main processor 112 and then displays an appropriate message on the alphanumeric display 26, and if appropriate, energizes one of a plurality of liquid crystal segments on the LDC display 24.

Figure 4:
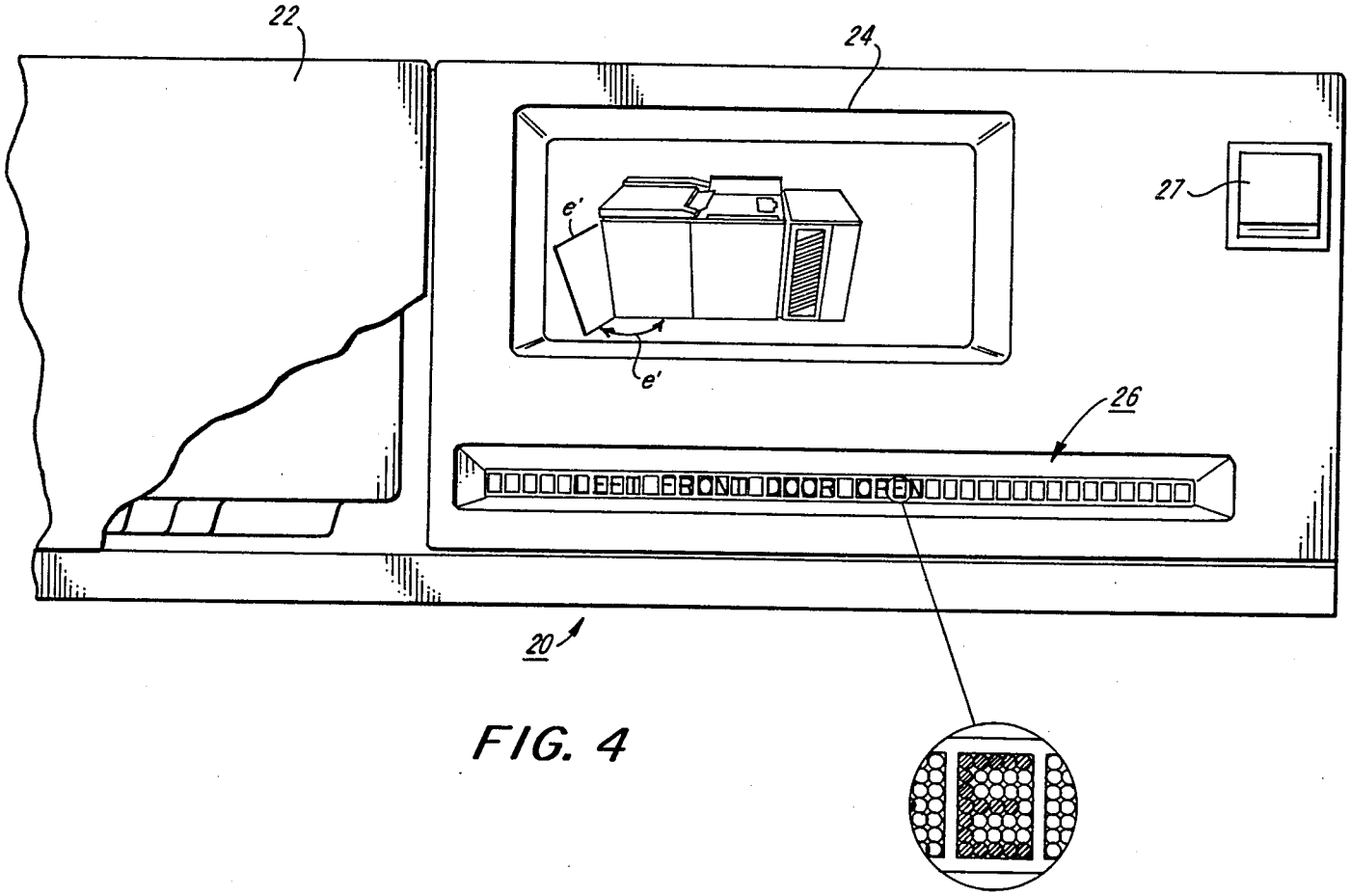
FIG. 4 shows a enlarged portion of a display panel which updates the user regarding copier status.

Both the alphanumeric display 26 and liquid crystal display 24 can be seen more clearly in FIG. 4 which shows an enlarged view of the front panel. As seen in that Figure, the liquid crystal display 24 is mounted directly above the alphanumeric display 26 and located to the side of the flip chart 22. The alphanumeric display 26 comprises a vacuum fluorescent tube capable of generating messages helpful to the copier user. Each of a maximum of forty characters is generated by a 5×7 dot matrix pattern wherein each of the thirty five dots comprising the 5×7 dot matrix can be individually energized. The use of the 5×7 dot matrix allows not only Roman characters for generating information in English but also can be modified to produce different fonts suitable for presenting messages in other languages which requires totally different character sets.

The liquid crystal display 24 positioned directly above the alphanumeric display includes various liquid crystal segments to aid the copier user in both interacting with the copier and correcting faults should they occur during operation. The display 24 is a graphic mimic-type display wherein the particular copier configuration with which the user is interacting is outlined on the display. The outline is separate from the liquid crystal display so that it can be changed according to copier architecture. In the FIG. 4 illustration, the copier left hand front door is open so that the liquid crystal elements illustrating that door are energized and a message appears on the alphanumric display 26 indicating the left front door has been left open.

Figure 5:
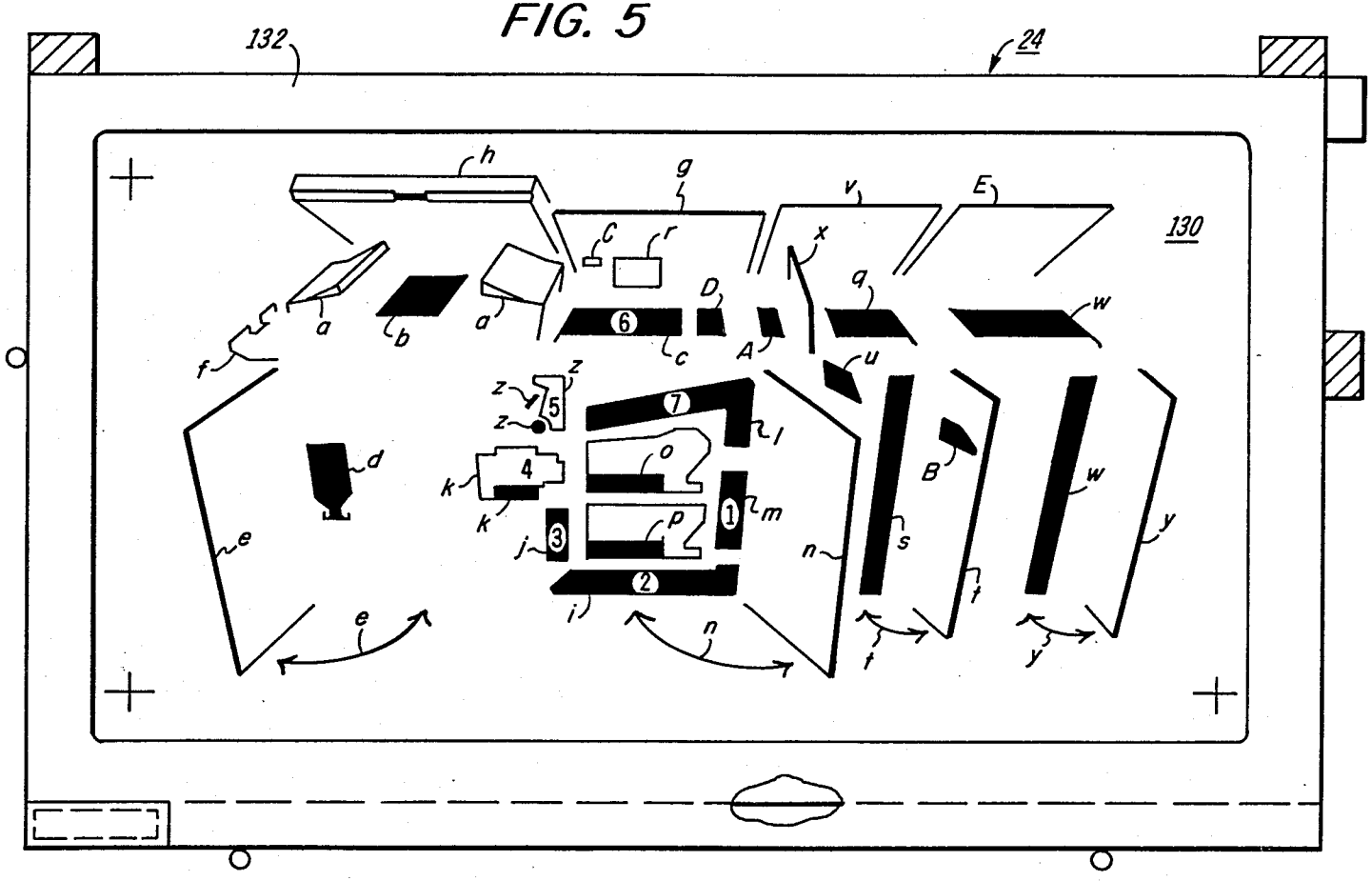
FIG. 5 illustrates the shape and positioning of multiple liquid crystal elements used in graphically illustrating copier status.

Turning now to FIG. 5 a pattern of liquid crystal elements a–z and A–E is shown as they are configured on the liquid crystal display. The Table below indicates the component or condition each element in the array represents.

TABLE 1

| Segment Designation | Segment Definition |
|---|---|
| a | RDH Side Covers Open |
| b | Platen |
| c | Zone 6 Paper Path |
| d | Dry Ink Bottle |
| e | Left Front Door |
| f | SADH Output Tray |
| g | CPHM Top Cover |
| h | RDH/SADH Open |
| i | Zone 2 Paper Path |
| j | Zone 3 Paper Path |
| k | Zone 4 Paper Path |
| l | Zone 7 Paper Path |
| m | Zone 1 Paper Path |
| n | Paper Tray Door |
| o | Paper Tray 1 |
| p | Paper Tray 2 |
| q | Sorter Horizontal Paper Path |
| r | Flip Cards |
| s | Sorter Vertical Paper Path |
| t | Sorter Front Door |
| u | Stitcher Paper Path & Stacker Only Output Tray |
| v | Stitcher/Sorter Top Cover |
| w | Tanden Sorter Paper Path |
| x | Stacker Only Top Cover |
| y | Tandem Sorter Door |
| z | Zone 5 Paper Path |
| A | Stacker Only Paper Path |
| B | Finisher Output Tray |
| C | Auditron |
| D | Processor Output Tray |
| E | Tandem Sorter Top Cover |

In reviewing the elements of the above table it should be appreciated to one skilled in the art that any individual copier configuration will not include all the elements listed in the Table. It should be apparent, therefore, that a copier configured to include a single sorter such as the one illustrated in the display of FIG. 4 will not include those elements associated with a stacker. The liquid crystal display 24, however, includes all the elements listed in the Table and it is the function of the control electronics in the display console remote unit 125 to distinguish copier configuration and only energize an appropriate element in the multiple element display.

Figure 6A:
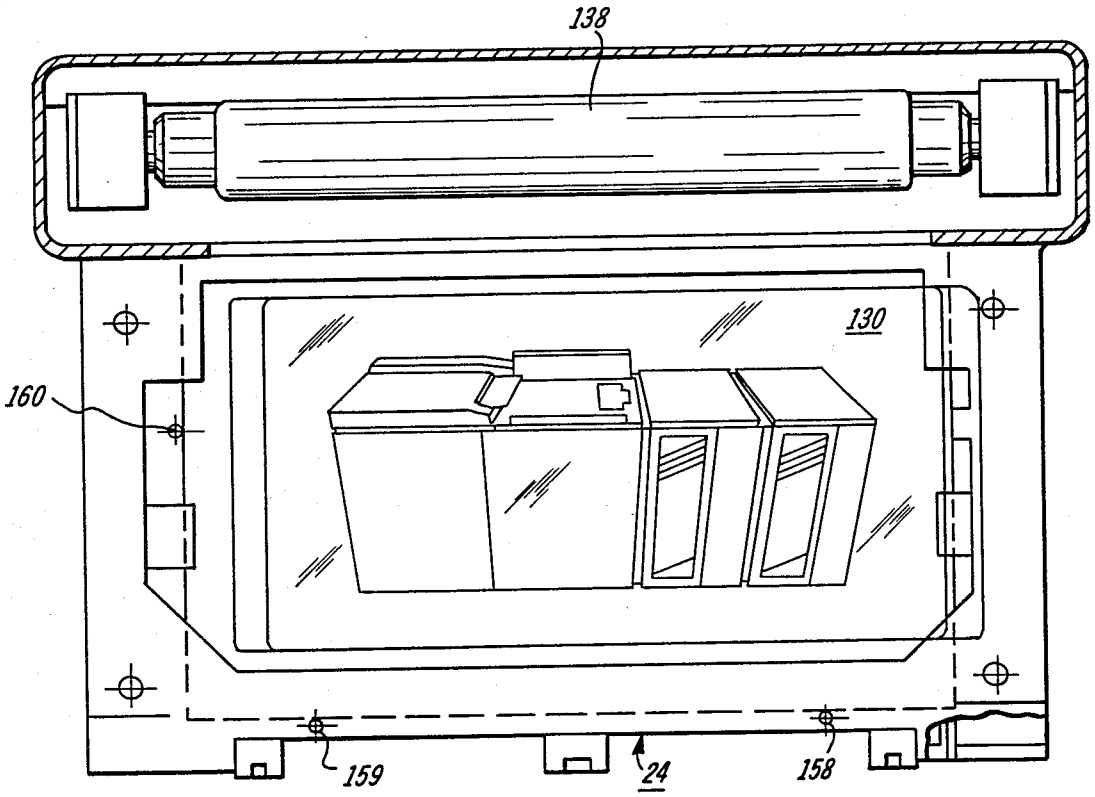
FIGS. 6A and 6B are elevation side and end views showing the manner in which the liquid crystal display is mounted to the copier.
Figure 6B:
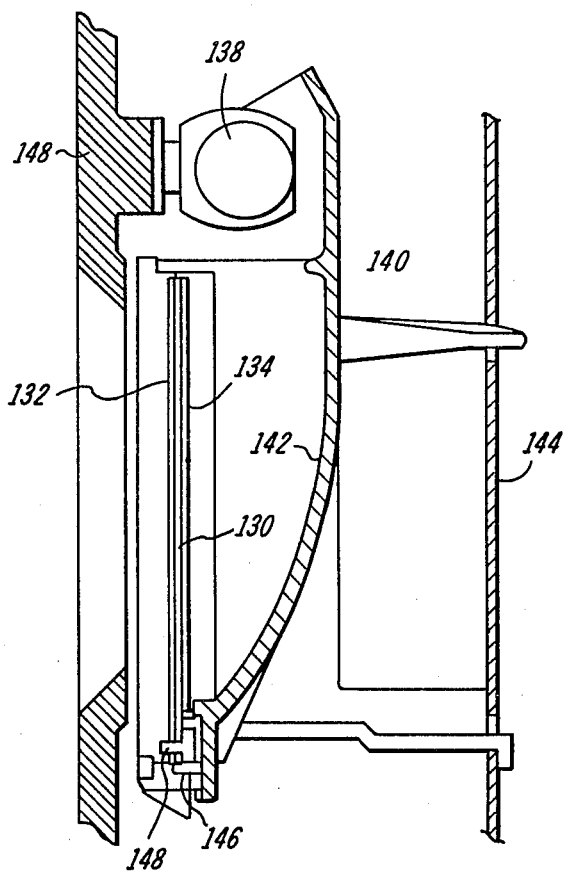
Figure 7A:
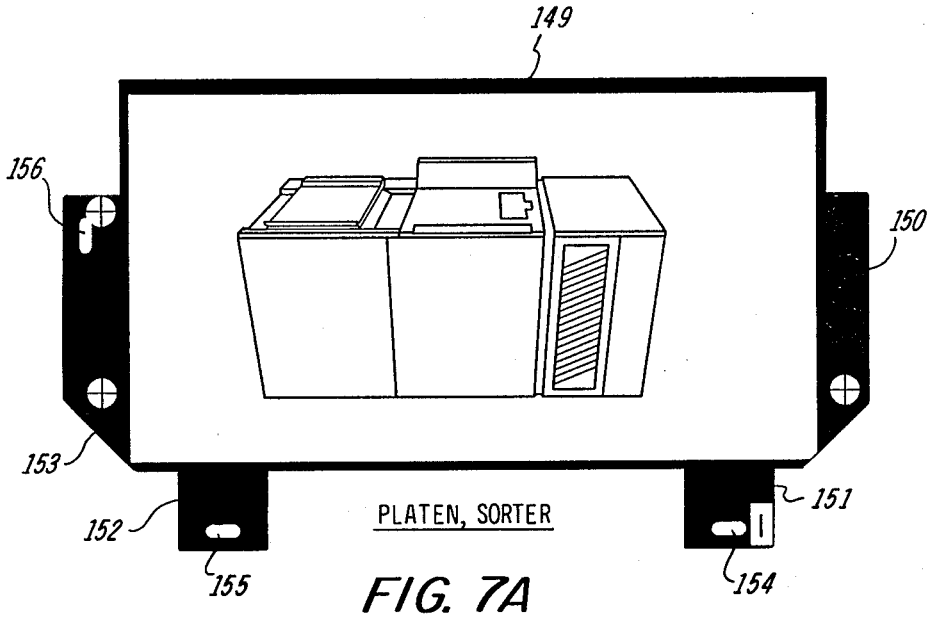
FIGS. 7A–7H show overlays used in conjunction with the liquid crystal display for displaying to the user a particular copier configuration.
Figure 7B:
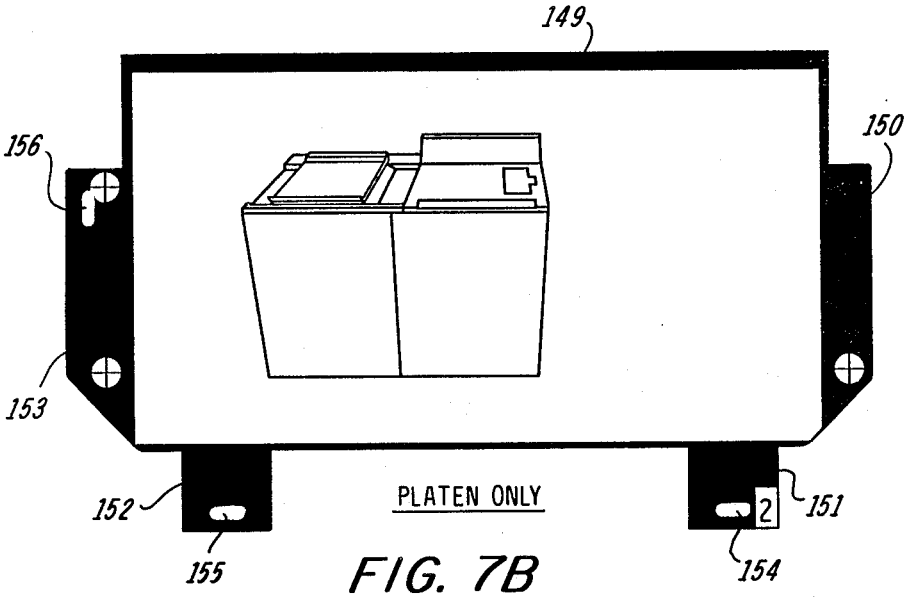
Figure 7C:
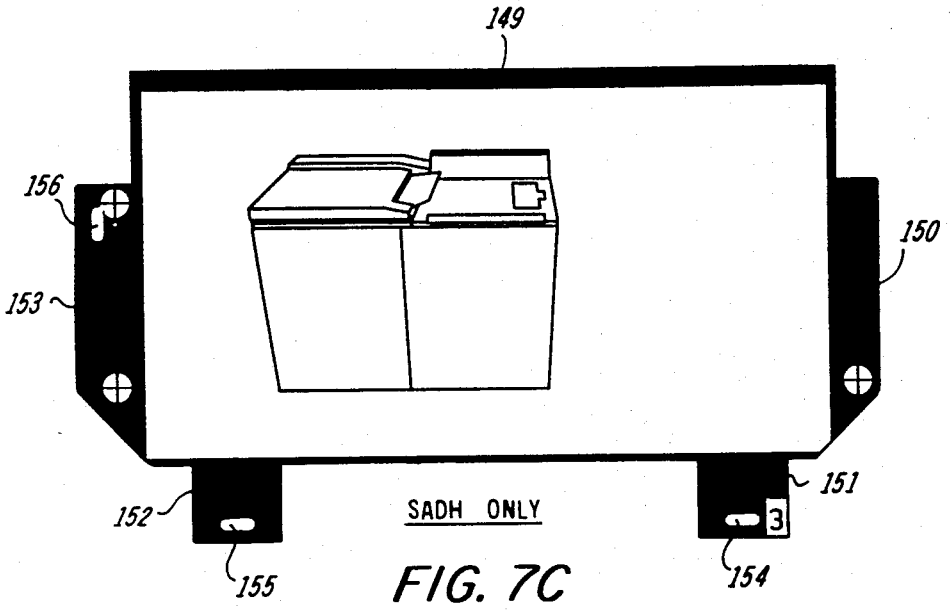
Figure 7D:
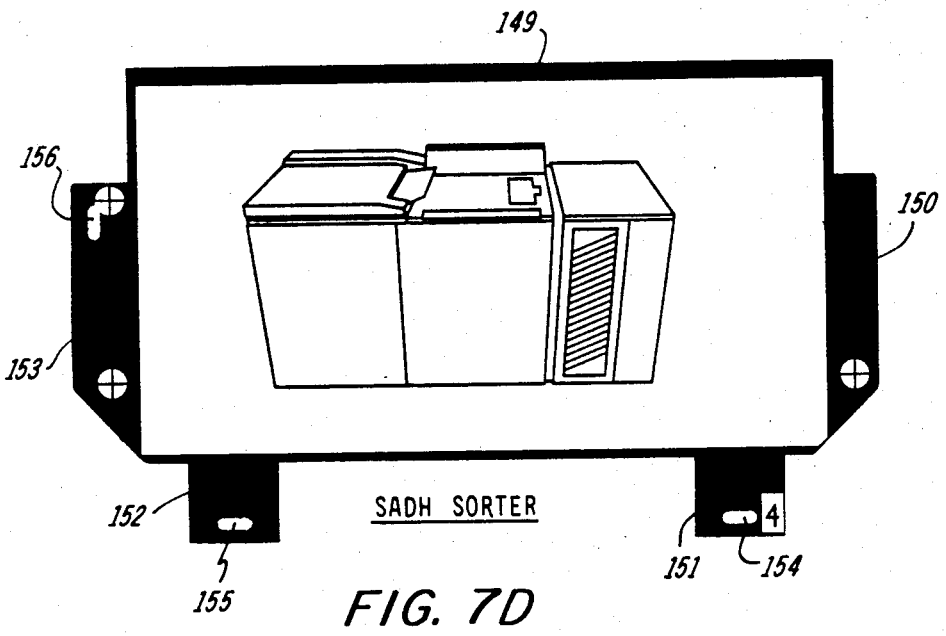
Figure 7E:
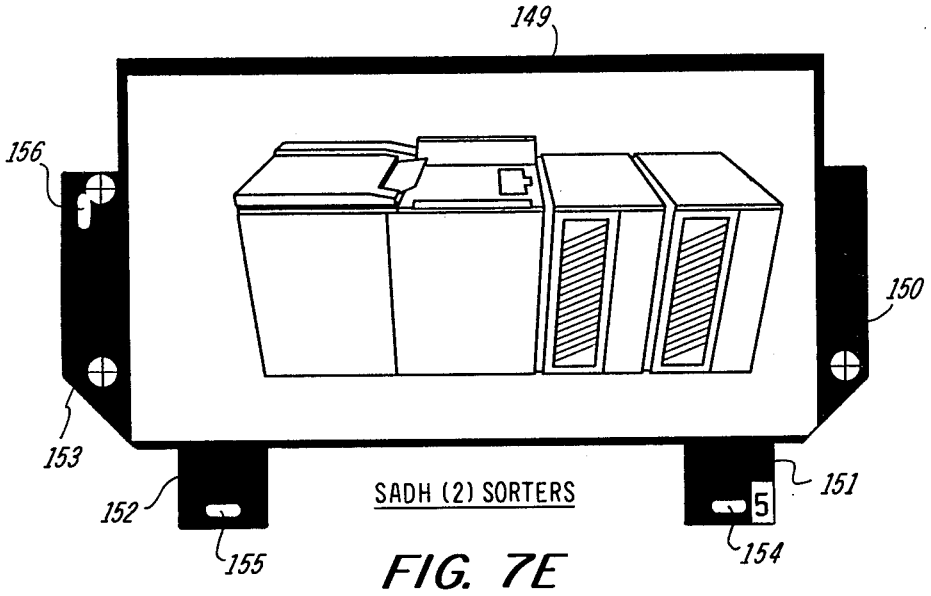
Figure 7F:
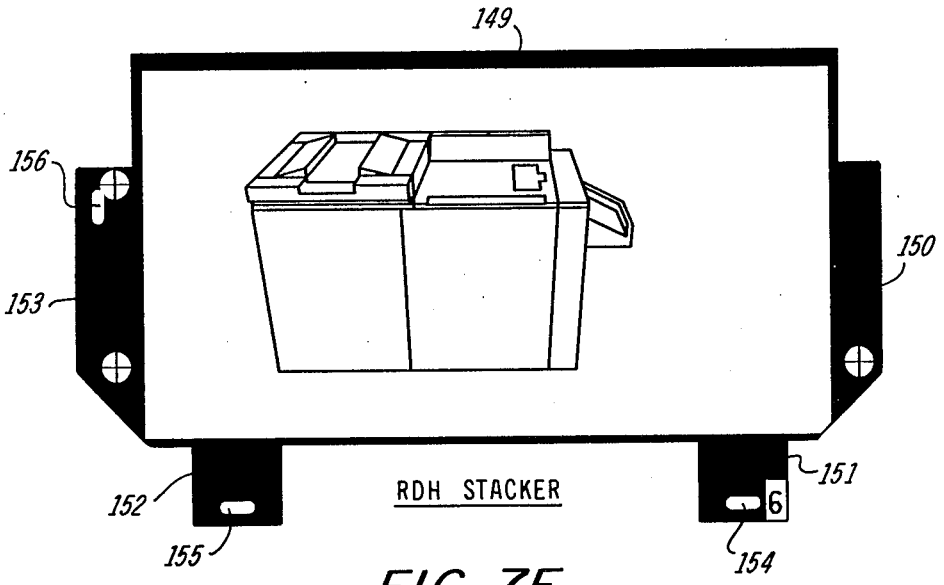
Figure 7G:
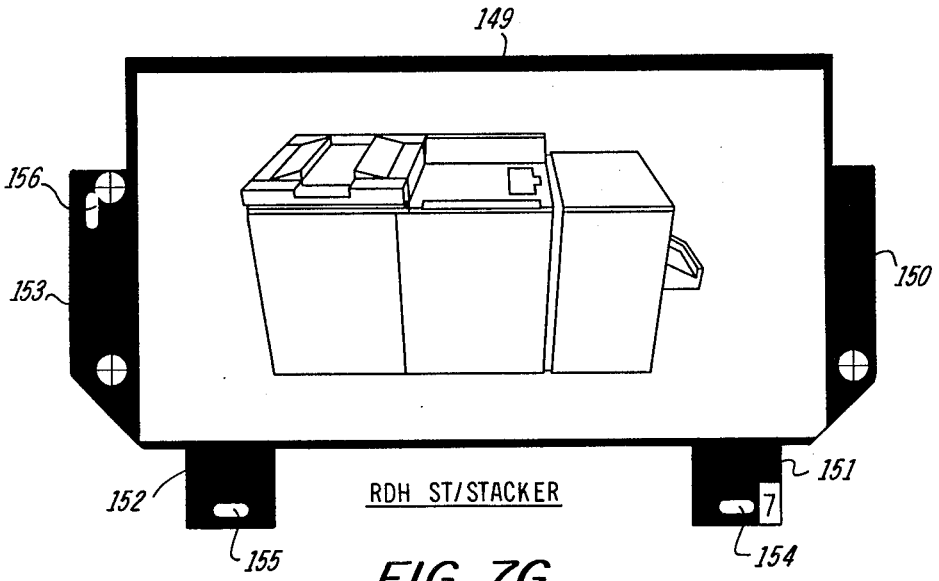
Figure 7H:
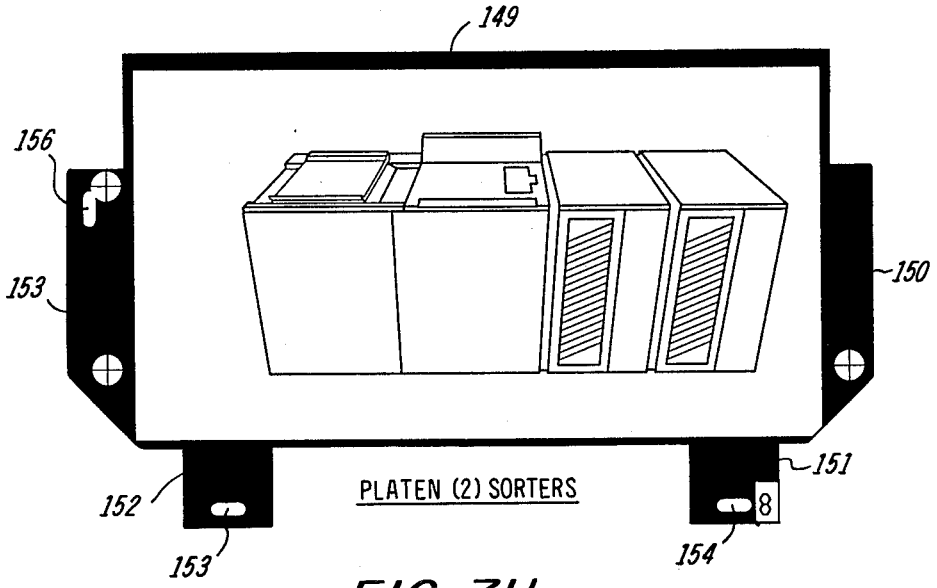

Each liquid crystal in the display is coupled by a conductive path to an individual connector at the bottom of the display which enables the display 24 to be inserted into a socket located beneath the display. When a particular conductive path is energized with a voltage signal, the segment coupled to the individual connector is energized causing that portion of the display to become visible. Particulars regarding liquid crystal operation can be found in the literature so that it is not believed extended discussion of how the particular elements are formed in the display is necessary. The particular display shown in FIG. 5 is a custom display designed by the assignee of the invention and obtained from the Crystaloid Electronics Company, P.O. Box 628, Hudson, Ohio 44236. Briefly, the liquid crystal display 24 comprises two layers of glass pressed together to form a layered sheet 130 mounted by front 132 and back 134 supports which outline the sheet 130. These layered sheets comprise polarizing material needed to render visible the liquid crystal segments formed in the center between the two sheets. A fluorescent tube 138 (FIGS. 6A and 6B) directs light through a chamber 140 behind the display which is bounded by a reflective surface 142 made of ABS white plastic. When the liquid crystal elements a–z and A–E are in an unenergized state, the front and rear polarizers allow only blue light reflecting off the surface 142 to reach the user. When one of the polarizable elements in the liquid crystal, however, is energized, the combined effect of the three polarized segments, i.e. the front and rear polarized layers in combination with the electrically polarized liquid crystal element allows white light to reflect off the surface 142 and pass through the energized segment of the liquid crystal to the user. Thus, when an appropriate one of the liquid crystals is energized by a signal from the display console remote unit 125, it is rendered visible due to white light passage through that segment. This segment is, of course, bounded by a blue field. Alternate display designs such as a colored liquid crystal on a white background are possible. It is also possible that both the background and liquid crystals can be colored. A colored liquid crystal uses only one polarizer and has the color inherent in the liquid crystal material. Certain dichroic and diazo dyes are used for the colored liquid crystal implementation.

As appreciated to one skilled in the art, the liquid crystal segments will be damaged if the energization signal from the display console remote 125 is of a direct current nature. For this reason, those liquid crystal segments which are to remain visible are energized with a 42 Hz signal rather than a continuous signal. If a liquid crystal segments is to be blinking on and off, the liquid crystal segments will be energized with a 42 cycle per second signal de-energized for a certain off time period and then again energized at the alternating signal frequency. The fluorescent tube 138, reflecting surface 142, and liquid crystal display are each mounted to a printed circuit board 144 comprising a portion of the display console remote unit 125. Once the layered sheet 130 has been inserted into a socket 146, a front mounting bracket 148 is positioned over the display to hold the display in place. The bracket 148 includes slotted holes on a bias through which threaded connectors (not shown) are inserted to mate into a display body. With slight pressure applied at the top of the bracket the layered sheet is automatically biased against three mounting posts 158–160. When the bracket is tightened it firmly holds the layered sheet in place so the electrical connection used to energize the liquid crystal elements is secure.

As mentioned previously, a permanently visible overlay 149 including an outline of the copier configuration with which the user is interacting is positioned over the layered sheet 130 to help orient the user as the liquid crystal elements a–z and A–E are energized by the display console remote unit 125. Eight different overlays are shown in FIGS. 7A–7H. Once the purchaser or lessee of a particular copier determines the particular configuration of that copier, the overlay corresponding to that configuration is mounted onto the liquid crystal display 24 without the use of any tools to align the overlay to the layered sheet 130 and remains affixed in place on that display until the copier architecture is changed. As seen in FIGS. 7A–7H, a typical overlay includes an outline of a copier architecture surrounded by a transparent piece of plastic bounded by a number of mounting tabs 150–153. Three of these mounting tabs 151–153 define registration holes 154–156 which align the copier outline in relation to the liquid crystal elements defined by the layered sheet 130. When the overlay 149 corresponding to a particular copier configuration is mounted to the display 24, these three registration slots 154–156 fit over three corresponding registration mounting posts 158–160 formed in the display mounting bracket (see FIGS. 6A and 6B). As should be readily apparent from FIGS. 7A–7H different copier architectures utilize different overlays and it should also be apparent that the liquid crystal display 24 itself includes all energizable elements a–z and A–E regardless of the copier architecture. As mentioned above, it is the function of the control electronics to insure that those liquid crystal elements representative of elements not included in the architecture are never turned on to let reflective light transmission occur.

Figure 8:
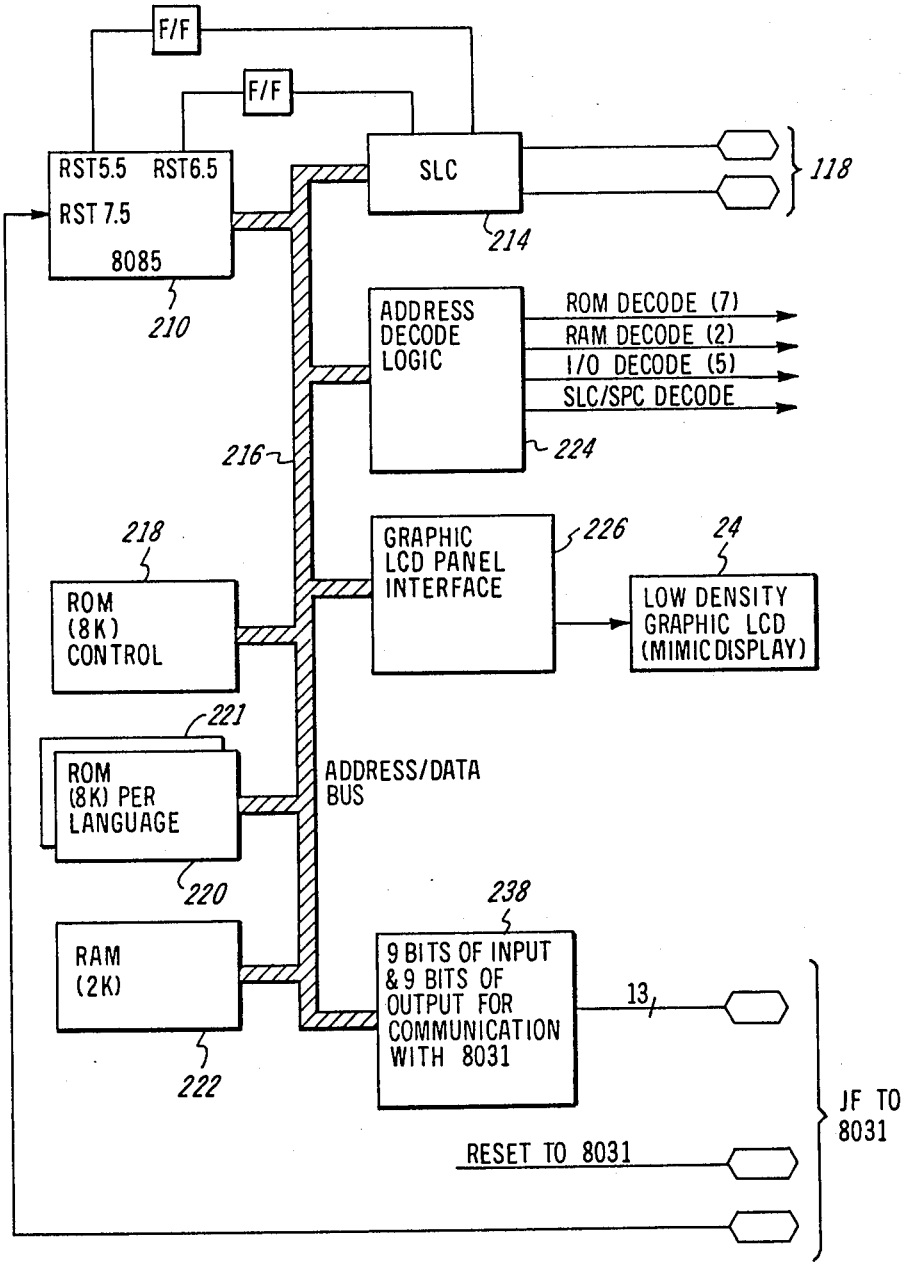
FIG. 8 shows an electrical schematic for one of two microprocessors used for energizing the LCD and alphanumeric displays.

The display console remote unit 125 (FIG. 3) comprises two microprocessors 210,212 (FIGS. 8 and 9). The first of the two microprocessors 210 comprises an Intel 8085 microprocessor which communicates with the master processor 112. The display console remote unit 125 also comprises a special communications very large scale integration integrated circuit 214 for converting signals from the master processor 112 which appear on the communication bus 118 in the form of serial communications packets into parallel communications for receipt on the 8085 data/address bus 216.

The communication chip 214 is a custom integrated circuit to perform a communication's protocol similar to the Ethernet® protocol developed by the assignee of the present invention. The serial communications performed by the various processing units in the present copier is of a similar packet sending type wherein a priority of message transfer is established and wherein each of the processor units 120–125 must obtain command of the communications bus 118 in order to transmit messages to other ones of the remote units. The communication chip 214 receives packets of information which are converted into parallel signals for receipt by the 8085 microprocessor 210. The typical signals along the serial communications line will indicate to the 8085 the status of the copier as well as faults which may have occurred during copier operation.

It is the function of the 8085 to interpret the communications appearing on its data/address bus 216 and cause an appropriate message to be displayed as well as, in appropriate situations, energize certain ones of the LCD elements in the display 24. In the system incorporated in the present invention approximately one hundred thirty different messages are transmitted along the serial communications line from the master microprocessor 112 to the 8085 in the display remote unit 125. The 8085 microprocessor 210 is supported by four memory units, 218,220,221,222. A first three of these memory units 218,220,221 comprise 8K ROM memory chips which directly interface with the 8085 data/address bus. As is appreciated to one skilled in the art, these ROM chips 218,220,221 can only be read by the 8085. It is the first one of these ROm chips 218 which stores the 8085 operating system which interprets the serial communications messages transmitted by the master processor 112. The two other ROM chips 220,221 have typical messages stored in non-volatile memory for display on the alphanumeric display 26. In performing its message display service, the 8085 microprocessor 210 must have available to it certain memory locations to which it can write data so that a 2K RAM unit 222 is also included.

The 8085 microprocessor 210 is programmed to perform much of its input/output using memory mapped input/output techniques. As is familiar to those skilled in the art, the use of this technique requires the generation of various enable signals to cause various circuits to either transmit data to the 8085 data bus or to read data from that bus. The generation of these enable signals is performed by an address decode logic circuit 224. As indicated in FIG. 8, this address decode logic circuit 224 generates seven ROM decode signals, two RAM decode signals, a signal for decoding the communications chip 214 and five special input/output decode signals.

When power to the copier is turned on, the operating system stored in the first ROM location 218 performs a number of initialization steps before it is ready to energize the LCD 24 or alphanumeric 26 display. During the initialization phase the display unit 125 is apprised of the copier configuration by the master processor 112.

The operating system next monitors message packets from the master processor and determines if the information it receives is fault information, status information, or so-called program information. A typical fault message might be an indication that a front door 13 on the housing 12 is open, a typical state message might be that the copier is ready, and a typical program mode message might be that the user has decided to adjust copy contrast and needs to be prompted into doing so. A subset of the fault messages are so-called dual fault codes which can be associated with two copier configurations. When these codes are encountered, the processor must first determine the copier configuration and then display an appropriate message. Each message has a unique designation which enables the 8085 microprocessor to find an appropriate message for each such designator.

The determination of what message is to be displayed for each message designator is performed using a look-up table in one of the 8K ROM chips 220,221. Each of these 8K language ROMs has three separate look-up tables; one for fault messages, one for status and program mode messages, and one for the dual fault messages. Once the 8085 determines what type of message it has, it points to the appropriate look-up table, offsets an amount equal to the message designator and then reads the message at that location from one of the 8K ROMs into its RAM memory space 222.

The particular message for each designator comprises a nine byte header and either a forty or eighty byte message. The first byte in the nine byte header indicates whether any liquid crystal segments in the display should be activated. The next eight bytes indicate which liquid crystal segments are energized and whether they are to blink or remain visible continuously. Each byte in the forty (or eighty) remaining bytes corresponds to a character in the 40 character alphanumeric display. Each eight bit byte in this portion of the message corresponds to a unique energization scheme for the 35 dots making up each vacuum fluorescent character. By changing the ROM, the message can be displayed in languages having varying alphabet fonts such as cyrillic, KATA-KANA, etc. Also, as noted above, the look-up table technique of message generation allows different languages to be supported by simply changing the ROM look-up table the 8085 accesses for its message.

Figure 11:
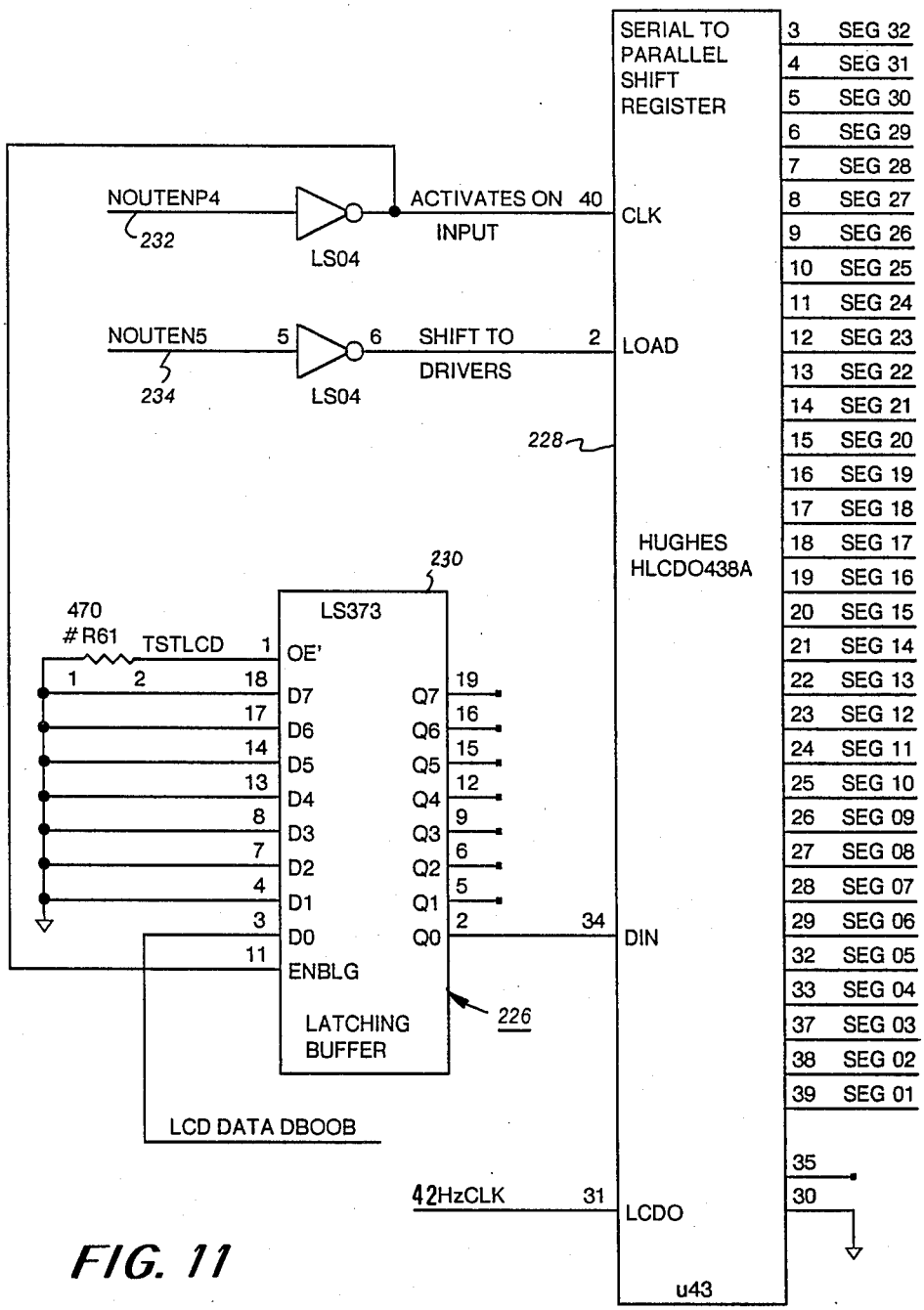
FIG. 11 illustrates the interface between the FIG. 8 microprocessor and the liquid crystal display.

An interface circuit 226 (FIG. 11) for energizing particular liquid crystal segments in the display 24 directly interfaces the 8085 data/address bus 216. The liquid crystal display (LCD) interface comprises a serial to parallel shift register 228, a buffer 230, and two inputs 232,234 from the address decode logic circuit 224. The buffer 230 is directly coupled at pin 3 to line 0 of the 8085 data bus. When the buffer enable at pin 11 of the buffer 230 is set, the data appearing at pin 3 is latched by the buffer 230 as an output at pin 2. Subsequent to this latching step, the output at pin 2 is transmitted to the input at pin 34 of the serial to parallel shift register 228. By reference to FIG. 11, it is also noted that the enable signal for the buffer 230 serves as a clock signal for the serial to parallel shift register 228 so that each time a data bit is latched by the latching buffer 230, it is simultanously clocked into the serial input at pin 34 of the shift register. It should also be appreciated that a second input 234 is coupled to pin 2 of the shift register to serve as enable signal for that shift register.

The serial to parallel shift register 228 includes a series of 32 output pins which are directly coupled to the LCD segments on the display 24. Once the serial data has been loaded sequentially into the shift register 228, it is available as an energization signal to the LCD display in response to a 42 cycle output control signal at pin 31 of the shift register 228. The 8085 clock cycle is fast enough so that the shift register can be loaded between successive pulses of the 42 Hz output signal. Thus, in order to change the scheme of LCD energization, the 8085 microprocessor 210 need only energize the load input signal 234 of the shift register, transmit the serial data to the shift register and await the next of the 42 cycle output signals. The microprocessor 210 has the capability, therefore, of energizing a particular LCD segment so as to cause that segment to appear to flash on the display 224. Thus, for example, the segment can be energized for 21 output cycles, de-energized for 21 output cycles in an alternating fashion to cause a chosen LCD segment to flash on and off each second.

Returning now to FIG. 8, one sees that the 8085 microprocessor 210 communicates with a 8031 microprocessor 212 (FIG. 9A and 9B) along a nine bit parallel communications channel 238 which instructs the 8031 microprocessor 212 regarding the information to be displayed on the alphanumeric display 26. Eight of the nine bits on this parallel communications channel are coupled from the 8085 data bus 216 to an 8031 data bus 240 through a pair of data buffers 242,244 (FIG. 9B). On an input portion of data communications, a first buffer 242 receives an CLK input 243 from the address decode logic circuit 224 when the 8085 microprocessor wishes to transmit data to the 8031 microprocessor. Receipt of this signal 243 causes a flip flop 245 to interrupt the 8031 with an input 248 which causes data appearing at the nine bit data channel to be read by the 8031 microprocessor. One of the nine bits is received along an input 247 to 8031 port P1.4. The interrupt routine of the 8031 first reads this bit and then reads the contents of the eight bit buffer 242 and stores this byte in one of the 8031 internal registers (one of 128). Each time the 8031 microprocessor 212 reads data from the buffer 242, a signal 250 which enables the buffer output is generated by an 8031 address decode circuit 252. This signal 250 also resets the flip flop 245.

The 8031 can also transmit eight bits of data back to the 8085 microprocessor through the second 244 of the two data buffers. In accordance with the present invention, the only signal transmitted from the 8031 microprocessor 212 to the 8085 microprocessor 210 is an acknowledgement that data has been received from the 8085 microprocessor. In operation, the 8085 microprocessor 210 receives an indication from the master controller that a particular copier configuration or status has been achieved or that a fault has occurred. The 8085 through a program stored in its operating system ROM chip proceeds to analyze the status and/or fault to determine what message should be displayed on the alphanumeric display 26. That message is then transmitted from the 8085 to the 8031 microprocessor and stored in the 8031 internal RAM space.

The following describes the communications protocol that is used for communicating between the 8031 and the 8085. This protocol transmits information in units called packets. The packets are capsules of information containing a header byte and string of data bytes. The header contains a four bit command field which describes the content of the message. Three bit checksums are transmitted both in the message packet itself and in the ACK (acknowledge) that is sent back when the packet is correctly received. If an ACK is not received within one to two milliseconds of the transmission the packet is retransmitted by the 8085. In addition to the packet length and the checksum, the header contains a one bit sequence number. The ninth bit input at port 1.4 is used as a flag to differentiate between header and data bytes. When this bit is set, it indicates a header byte is in the byte section of the port. This can be considered to be the start of packet flag. The 8031 routine interrupts for every new byte written into it port. It reads bit P1.4 to determine if it is to process a header or a data byte and then reads the byte part of the port. The 8031 builds up the packet in a buffer until it has read the number of bytes implied by the command field of the header. At this point the receiver calculates the checksum of the message and compares it with the checksum contained in the header byte. If the checksums agree the 8031 acknowledges the packet. The acknowledge contains the checksum and sequence number of the packet it is acknowledging. If the checksum was incorrect, or if the header byte of a next packet was detected before the first packet was completely received, no action is taken and the message will be retransmitted. If the received message was an ACK, the transmitter will be reenabled.

The 8031 must convert the data generated by the 8085 processor into signals appropriate for energizing the alphanumeric display 26. One convention utilized by the present invention is a modified ASCII representation of the data. Therefore, stored in the internal memory of the 8031 microprocessor might be 40 ASCII-like bytes representing 40 alphanumeric characters to be displayed on the display. The 8031 accesses a look-up table in its own 4K ROM space 272 to find an appropriate 35 bit pattern (in nine data bytes) to display on each 5×7 dot matrix comprising the alphanumeric display 26.

Figure 9A:
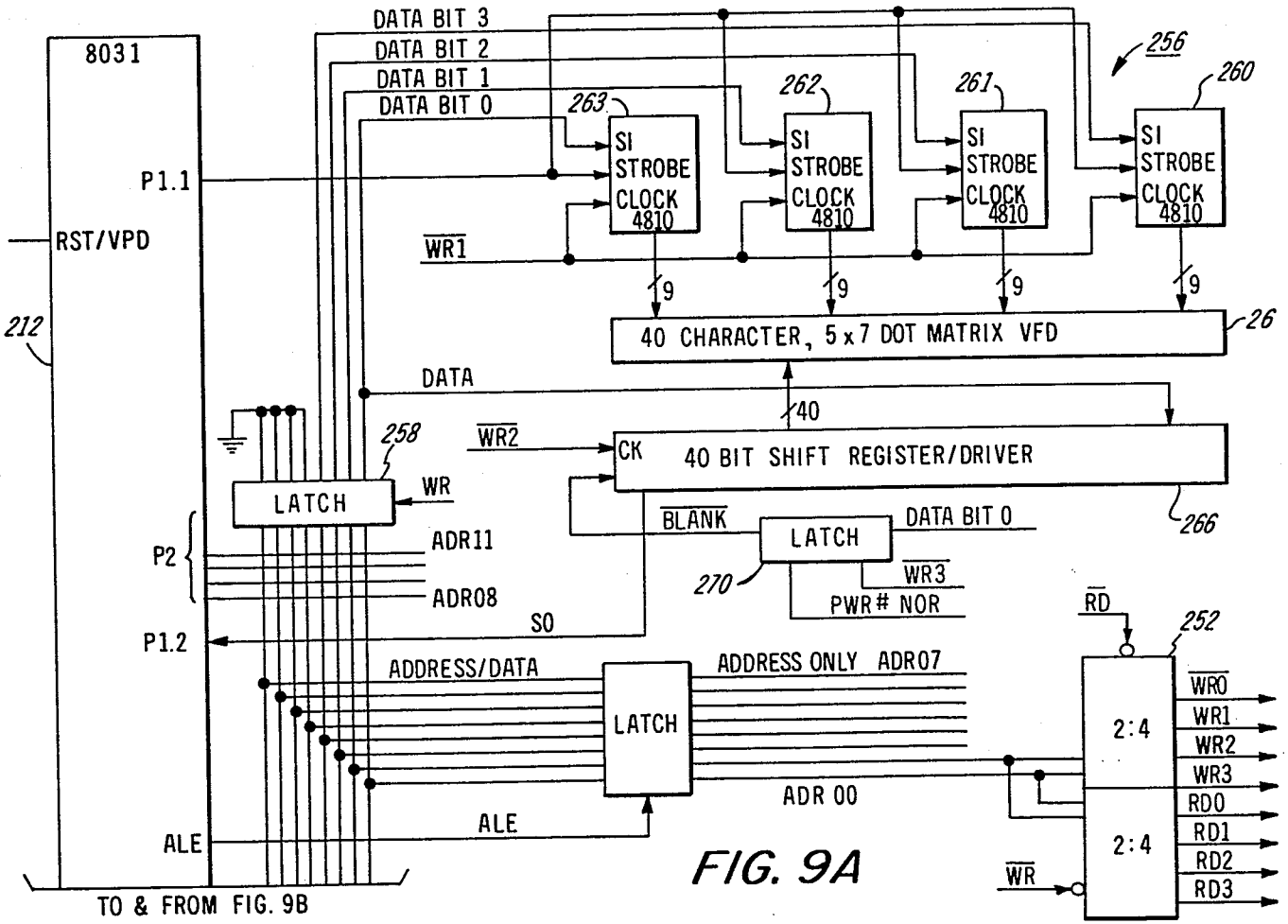
FIGS. 9A and 9B schematically illustrate the electronic arrangement for a second microprocessor which primarily functions to display and continually update the information on the alphanumeric display.
Figure 9B:
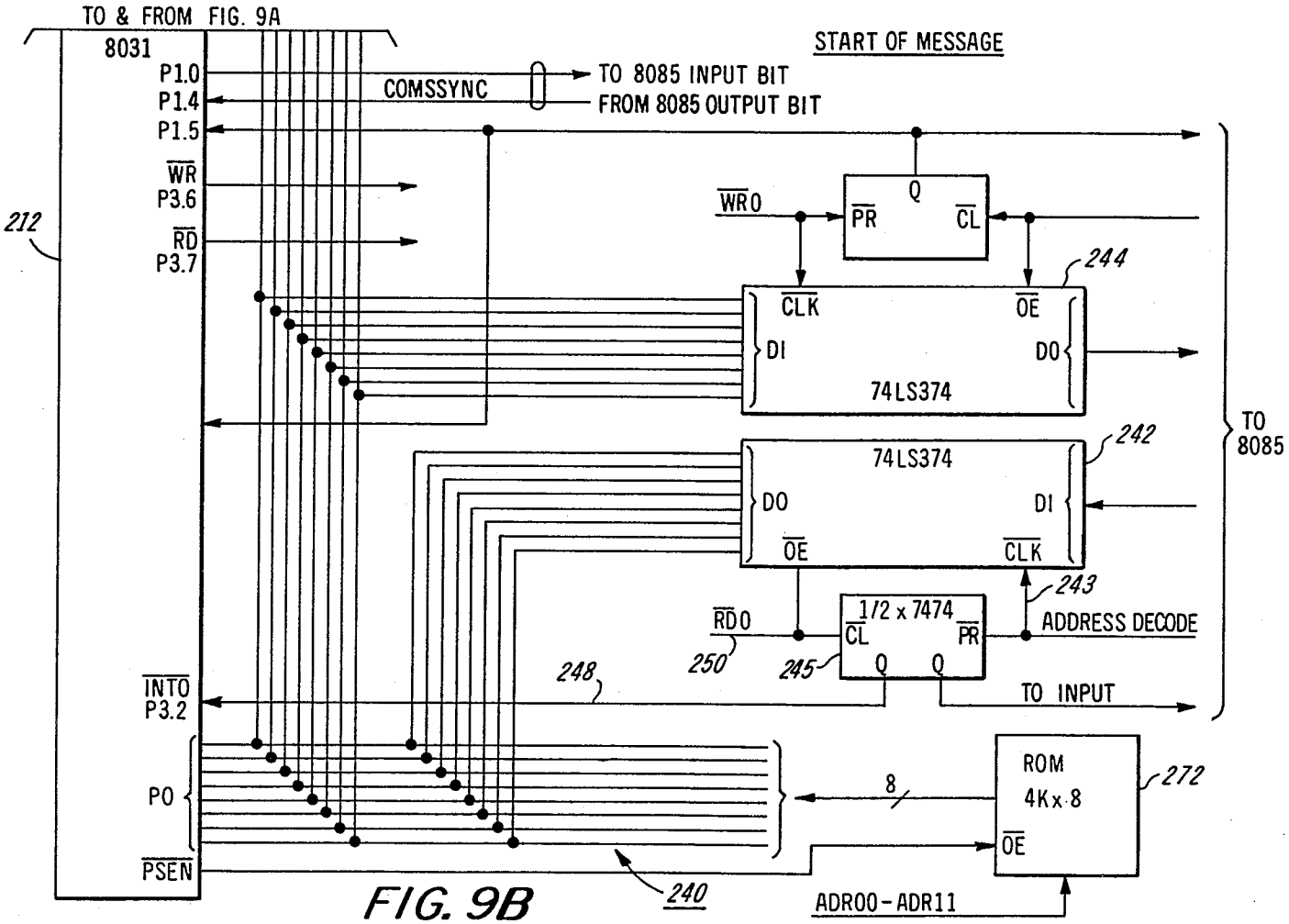
Figure 10:
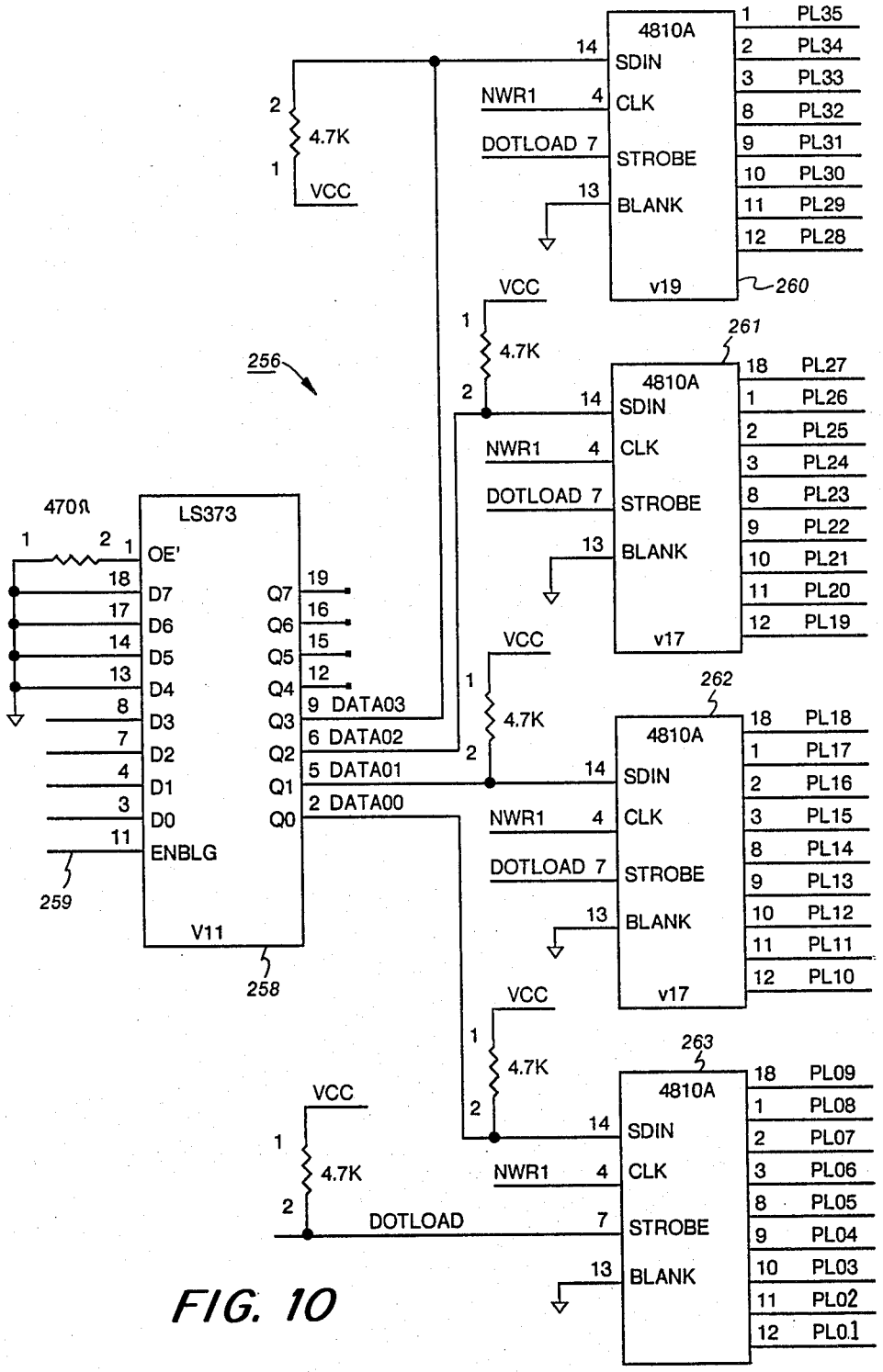
FIG. 10 shows the particulars of an interface between the FIG. 9 microprocessor and the character generator.

A display energization circuit 256 has been shown schematically in FIG. 9 and in more detail in FIG. 10. This circuit comprises a data latch 258 having four inputs which interface with the 8031 data bus 240. This latch is enabled by a signal 259 from the 8031 address decode circuit 252 (FIG. 9A) to latch onto four bits of data appearing on the 8031 data bus and transmit those four bits of data to four serial to parallel shift registers 260–263 which in a preferred embodiment comprise Sprague 4810A shift registers. As seen more clearly in FIG. 10, each of the four inputs on the latch 258 has an associated output coupled to one of the four serial to parallel shift registers 260–263. These four shift registers combine to provide thirty five output signals to the thirty five locations of a 5×7 dot matrix display. The forty 5×7 matrices comprising the vacuum fluorescent display have corresponding matrix locations electrically coupled together. It should be appreciated, therefore, that each time a shift register generates a control signal for a given matrix location this control signal is transmitted to each of the forty matrices. Only one of the characters is rendered visible, however, since the 8031 microprocessor also controls operation of a forty bit shift register 266 which sequentially renders active each of the forty alphanumeric dot matrices comprising the alphanumeric display. Thus, the 8031 microprocessor generates the pattern to be rendered visible on the display 26 by loading the shift registers 260–263 and is also responsible for making sure the 40 elements are sequentially activated via the forty bit shift register 266.

The preferred forty bit shift register 266 comprises four Sprague 4810A shift registers connected together to provide 40 control outputs, one for each dot matrix. To begin display of the first character, the 8031 microprocessor 212 writes to data latch 258 so that data bit zero is set. This high bit is then clocked to the forty bit shift register by the appearance of a $\overline{WR2}$ signal at the clock input to the shift register. This input is generated by the address decode circuit 252. On subsequent clock signals, the 8031 causes the zero bit at the output of the latch 258 to be low so that zeros are loaded into the shift register. As the zeros are loaded, the one high bit is clocked through all 40 positions so that all 40 matrices are sequentially rendered active.

The alphanumeric display is periodically blanked by transmitting a signal to the four blanking inputs to the shift register 266. This blanking signal is generated by a latch 270 clocked by a $\overline{WR3}$ signal to transmit a data bit zero signal corresponding to the blanking signal. The latch also blanks the display 26 when it receives a signal labeled RST which is generated by the master controller 112 during startup.

The timing for each character is 180 microseconds of display followed by 20 microseconds of blank display. To display all 40 characters requires 40×200 microseconds=8 milliseconds. The bit pattern for a subsequent character is loaded into the shaft registers 260–263 as the immediately preceeding character is being displayed.

It is instructive to examine the operation of the display console remote unit 125 in the event of a fault, such as, inadvertent opening of the left front door 13 on the copier 10. When the left front door 13 is open, the master controller 112 will immediately be apprised of this fact by an input from the xerographic remote unit 122. Receipt of this indication will cause the central processing master to generate a signal for transmittal to the display console remote 125, indicating that a front left door panel has been left open. This fault signal is received by the display console remote 125 and examined to determine whether a message is to be generated on the alphanumeric display 26 and whether one of the LCD elements, comprising the LCD display 24, should be energized.

The operating system stored in the ROM unit 218, associated with the 8085 microprocessor 210, will recognize the signal as a fault message and point to the beginning address of the fault look-up table in the ROM language chip 220 or 221. An offset will be added to this address corresponding to the designator for this fault and the 8085 will move a series of bytes corresponding to this fault into its RAM memory space 222. The first byte of this message will indicate that one of the liquid crystal elements comprising the liquid crystal display 24 is to be activated. The next eight bytes indicate which of the liquid crystal elements are to be energized and whether the one or more liquid crystal elements are to be energized in a continuous or blinking mode. When the left front door is open, the element labeled (e) in FIG. 5 must be energized. A particular one of the bits comprising the first four bytes in this eight byte sequence is set while all other bytes will be all zeros. If the LCD element (e) is to remain energized continuously, the same corresponding bit will be set in the remaining four bytes of this sequence of eight bytes. These bytes are selectively transmitted to the graphics LCD interface 226 in serial fashion (see FIG. 11) so that the output pin of the serial to parallel shift register 228 corresponding to this front left door LCD segment (e) is energized on successive clock pulses at pin 31 of that shift register. If the left front door LCD element is to blink on and off alternate ones and zeros will be output from that pin on the shift register to cause the energized element to remain energized for a selected period of time then be de-energized in an alternating fashion to cause the element (e) to blink on and off.

Also, stored in the ROM module 220 is a message (a series of 40 bytes) to be transmitted to the 8031 microprocessor 212. This message will be sequentially transferred to the 8031 microprocessor along the nine bit output bus 238 coupling the 8085 microprocessor 210 with the 8031 microprocessor. The 8031 microprocessor will store this entire message in its own internal RAM space so that an operating system stored in 8031 ROM chip 272 can convert the modified ASCII message into a sequence of bytes for selectively activating individual points of the 40 character dot matrix. In the FIG. 4 representation, the first visible letter comprising a message regarding the open door is the letter L which will be transmitted from the 8085 to the 8031 microprocessor. The 8031 operating system will include a conversion technique for converting the modified ASCII representation of the letter L into a nine byte sequence for transmission to the four shift registers 260–263 for energizing the appropriate dot matrix pattern. In the present scheme, only the low four order bits comprising these bytes are loaded so that, for each memory write cycle to the latch 258, the data regarding four pixel locations is stored in the shift registers 260–263. After nine memory write cycles, all thirty five pixel locations have been stored in those shift registers and so long as the 8031 correctly renders active an appropriate one of the 40 matrices comprising the 40 alphanumeric display, the letter (L) will be displayed in an appropriate position. As the (L) is displayed for 180 microseconds the dot pattern for (E) in the word "LEFT" is being loaded by the 8031 into the shift registers 260–263.

The 8031 microprocessor 212 continues to display the alphanumeric message "LEFT FRONT DOOR OPEN" until the 8085 microprocessor receives an indication from the master control unit 112 that the door has been closed. This display is accomplished by continually refreshing the display 26 until the 8031 receives an interrupt from the 8085 microprocessor. The display console remote 125 will ultimately be instructed from the master unit 112 to display a different status and/or fault message. In this way, information is continually updated for a user interacting with the copier 10.

Using non-volatile memory space for defining the language and font appearance on the alphanumeric display enhances the flexibility of the display. By substituting a different ROM chip 220 into the memory space of the 8085 microprocessor it is possible to use the same fault, status, and program code designators to display messages and prompts to the user in different languages. A switch on the front panel allows the language ROM (220 or 221) to be selectively switched from one chip to another so that the copier 10 becomes bilingual in its capabilities for communicating information to the user. Thus, for example, in one position the switch will cause a first ROM memory 220 containing English messages to be accessed by the microprocessor and when the switch is switched to a second setting, a second ROM memory 221 containing French messages is accessed. Both memory spaces will respond to the same designators but will differ in the messages stored. In a similar manner, the operating system for the 8031 can be easily changed so that, as data is transmitted along the nine bit bi-directional bus between 8085 and 8031 microprocessors, a given piece of data will cause different ones of the multiple elements comprising a 5×7 dot matrix to be energzied.

As noted above, the liquid crystal display 24 is also flexible since multiple copier architectures can be used without changing the makeup of the display. One need only insert a different overlay over the display so that the copier outline presented to the user is different for different architectures. It is also necessary, however, that the 8085 microprocessor never energize liquid crystal elements corresponding to components not embodied by the particular machine architecture being used. This is readily taken care of during an initialization stage in which the master controller 112 apprises the 8085 microprocessor 210 of the configuration with which the controller is operating.

The present display unit has been described with a degree of particularity. It should be appreciated, however, that certain design modifications, alterations or changes could be made in the present display. Thus, for example, although the alphanumeric display 26 has been described as being blanked, then loaded with characters and then displayed, the characters could be flashed or scrolled. The use of the display need not be limited to conveying information to the user but can be used in displaying diagnostic information for use by the tech rep. All such modifications and/or changes falling within the spirit or scope of the appended claims are intended to be protected.

We claim:

1. In a xerographic copier, a panel for displaying information regarding the status of said copier comprising:

message generation means having a number of individually addressable character generators which can be activated and thereby rendered visible;

a graphic display including a pattern of energizable elements which correspond to various copier components;

circuitry coupled to said graphic display and said message generation means to co-ordinate the visible message presented by the message generator means with the energization of said elements to inform a user viewing said panel of the status of said xerographic copier; and an overlay for said display which illustrates a copier configuration outline to aid the user in orienting the component represented by an energized element with the copier configuration.

2. The panel of claim 1 wherein said circuitry comprises a programmable controller having instructions for actuating said message generation means stored in a memory and where the form of the messages displayed on said message generation means can be altered by substituting a different memory.

3. The panel of claim 1 wherein said graphic display comprises a plurality of individually energizable liquid crystal elements.

4. The panel of claim 3 wherein said display further comprises a light source and means mounted behind said display for reflecting light from said source to said liquid crystals for transmission when said liquid crystals are energized.

5. In a xerographic copier, a front panel for displaying information to a user comprising:

an alphanumeric vacuum fluorescent character display where each character is made visible by energizing a pattern of individually addressable marix elements thereby rendering said matrix elements visible;

means for energizing each of the addressable matrix elements;

a liquid crystal display which defines a plurality of display segments corresponding to different elements of the copier;

means for outlining said liquid crystal display with a profile of a particular copier configuration to which said front panel is attached;

means coupled to said liquid crystal display for controllably energizing said display segments;

a programmable controller for energizing both said character display and said liquid crystal display, said controller operating from an instruction listing stored in a memory, said memory including a non-volatile memory portion which defines the appearance or said characters displayed by said character display; and means for communicating with said programmable controller to indicate the status of said copier so that said controller can display the status of said copier on said character and liquid crystal display.

6. The front panel of claim 5 wherein the non-volatile memory stores different languages for display by said character display.

7. A xerographic copier comprising:

a graphic display having a number of individually energizable display segments representing components of said copier which, when energized, are rendered visible and having an overlay which outlines a particular copier configuration in relation to the energizable display segments;

a character display for displaying characters to said user in a variety of display fonts;

a primary controller which monitors and controls xerographic functions as they are performed by said copier components;

a plurality of secondary controllers which communicate along a communications path with said primary controller where one of said secondary controllers comprises a display controller which selectively energizes said display segments and co-ordinates the energization of said segments with the display of information on said character display, said secondary display controller being apprised by said primary controller of the configuration of said copier so that only appropriate ones of said display segments are energized;

means for interfacing said display controller with said graphic and character displays; and said primary controller including means for generating status, fault, and program messages in response to receipt of information from other of said secondary controllers regarding the state and desired mode of operation of said copier.

8. In a xerographic copier, a panel for conveying information to a copier user comprising:

message generation means for presenting short variable content messages to said user;

a graphic display including a pattern of energizable elements which correspond to various copier components;

a plurality of cards carrying fixed information mounted to said copier for access by said user, said cards encoded with messages more complex than those which can be presented on said message generation means; and control means for co-ordinating the activation of said message generation means with the graphic display and for also controlling the content of said variable messages.

* * * * *